United States Patent [19]

Kraus et al.

[11] Patent Number: 4,915,302

[45] Date of Patent: Apr. 10, 1990

[54] DEVICE FOR MAKING ARTIFICIAL SNOW

[76] Inventors: Robert A. Kraus; Edmund J. Kraus, both of 1636-T E. Edinger, Santa Ana, Calif. 92705

[21] Appl. No.: 175,324

[22] Filed: Mar. 30, 1988

[51] Int. Cl.[4] ..... A01G 15/00

[52] U.S. Cl. ..... 239/14.2; 62/74; 239/430; 239/433

[58] Field of Search ..... 239/2.2, 14.2, 430, 239/433; 62/74

[56] References Cited

U.S. PATENT DOCUMENTS

| | | | |
|---|---|---|---|
| 1,229,344 | 6/1917 | Stevens | 239/430 |
| 1,462,680 | 7/1923 | Bliss | 239/430 |
| 3,774,843 | 11/1973 | Rice | 239/14.2 |
| 3,829,013 | 8/1974 | Ratnik | 239/14.2 |
| 3,908,903 | 9/1975 | Burns, Jr. | 239/14.2 |
| 4,145,000 | 3/1979 | Smith et al. | 239/14.2 |
| 4,214,700 | 7/1980 | Vanderkelen et al. | 239/14.2 |
| 4,383,646 | 5/1983 | Smith | 239/14.2 |
| 4,516,722 | 5/1985 | Avery | 239/14.2 |
| 4,759,503 | 7/1988 | Kraus et al. | 239/14.2 |
| 4,793,554 | 12/1988 | Kraus et al. | 239/14.2 |

*Primary Examiner*—Andres Kashnikow
*Assistant Examiner*—Michael J. Forman

[57] ABSTRACT

A continuous stream of compressed air is introduced to a elongated chamber surrounded by a distribution jacket for introducing water at substantially the same pressure via a multitude of inward directed tubular members into the stream of axially moving, decompressing air. The stream of partially decompressed air atomizes the introduced water into tiny droplets which are mixed with the air, and are accelerated through a converging-diverging exit nozzle so as to be projected through a distance, along which the swiftly moving droplets cool from their initial to nucleating temperature, and ultimately freeze into crystalline particles of ice.

1 Claim, 1 Drawing Sheet

DEVICE FOR MAKING ARTIFICIAL SNOW

FIELD OF THE INVENTION

This invention relates to a snowmaking device in which a continuous stream of compressed air is utilized to finely atomize a series of radially inward directed streams of water, and to accelerate the so atomized water into a jet of tiny, outwardly projected droplets which cool in contact with the colder atmospheric air from their initial to nucleating temperature and ultimately freeze into tiny, crystalline particles of ice before falling to the ground.

BACKGROUND AND SUMMARY OF THE INVENTION

The present, herein in detail described invention has been constructed, and has been tested at the beginning of the 1987 skiing season at the Goldmine Ski-Resort at Big Bear Lake, Calif. During the conducted tests, it has been found, that the device of the present invention operates satisfactory at marginal climatic condition while producing an adequate amount of good quality, artificial snow at a relative low air to water consumption rate. It should be mentioned, that, due to the extreme high cost of compressing air, the lowering of the relative air to water consumption rate is a most important factor in producing artificial snow.

Devices for the making of artificial snow have been known to exist, such e.g. one with the U.S. Pat. No. 3,829,013; or the device described in detail in our U.S. Patent filed on July 16, 1987, having the U.S. Pat. No. 4,759,503.

The devices of the prior art, while being thought of an sufficient for the making of artificial snow, are however, subject to certain limitation. Such as e.g. a high rate of air to water consumption; and the high noise level being produced in the spontaneous decompression of the compressed air to atmospheric pressure which is generated subsequent to exit from the device incorporated projecting nozzle.

It is therefore an object of the present invention to provide the means for lowering the relative air to water consumption rate.

Another object of the present invention is to provide the means for achieving a more evenly sized formation of water droplets, thereby reducing waste by colloidal suspension to fine of water droplets in the atmosphere.

A further object of the present invention is to provide the means for reducing the noise level associated with the spontaneous, radial outward decompression of the compressed air subsequent to exit from the device's exit orifice.

The features which we believe to be characteristic of the present invention, both as to their organization and method of operation, together with further objects and advantages will be better understood from the following description in combination with the accompanying drawings which we have chosen for purpose of explaining the basic concept of the invention, it is to be clearly understood, however, that the invention is capable of being implemented into other forms and embodiments within the scope of the present invention by those skilled in the art, such as e.g. the way by which the radially inward and slightly downstream angled water induction tubes are fastened to the water distribution jacket, and the geometrical shape of the well rounded exit orifice, which in the drawing is not to scale.

DESCRIPTION OF THE PRESENT INVENTION

Figure 1:
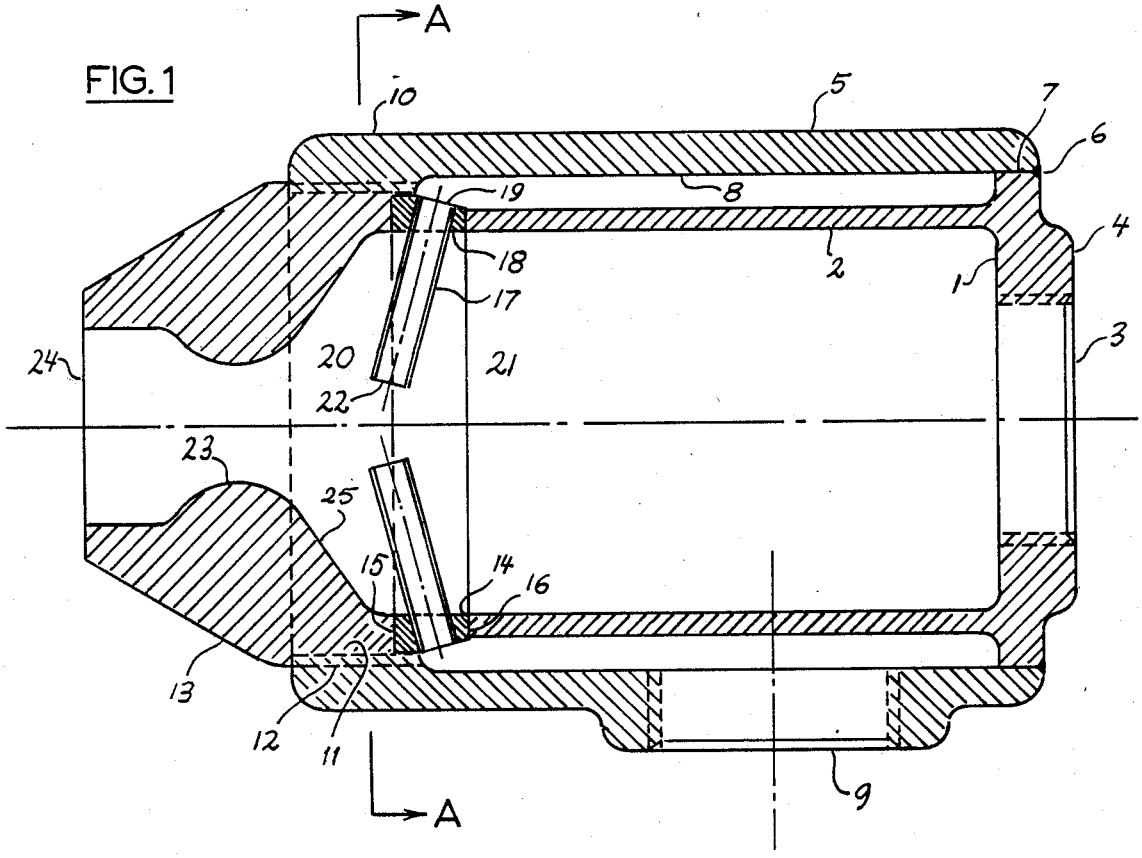
FIG. 1 shows the sectional side view of the present invention depicting the main housing including air and water inlet ports, the induction tube bearing water distribution ring, and the converging-diverging exit nozzle having a well rounded, constrictive portion.
Figure 3:
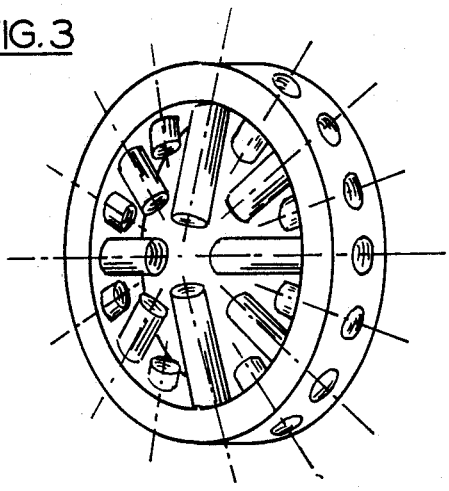
FIG. 3 represents a perspective view of the water induction tube bearing ring showing the different length and the forward angled direction of the ring installed tubes.
Figure 2:
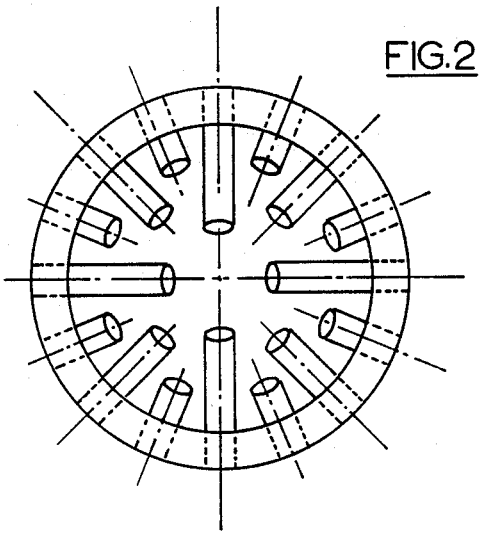
FIG. 2 shows the geometric arrangement of the water induction tube bearing ring through section A—A.

Accordingly, the present invention comprises the synthesized main housing portion 1 having the cylindrically extending inner member 2 having the internally threaded, axially thereto disposed air inlet port 3 at end 4, and having the coaxial thereto disposed, tubular outer member 5 which at end 6 is fused to the inner member outer surface 7 so as to form a portion of the annular water distribution jacked 8 surrounding the cylindrical inner member 2. The tubular outer member 5 having the internally threaded, laterally from the devices axial center outward extending water inlet port 9; and the axially at end 10 internally threaded portion 11. The converging-diverging exit nozzle 13 having the converging section 25, the well rounded internal constriction 23, and the diverging exit section 24; as well as having the externally threaded portion 12 which is in a threaded engagement with the internally threaded end portion 11 of the tubular outer member 5. The annular ring 14 is coaxial disposed within the tubular outer member 5, and is held firmly between end surface 15 of exit nozzle 13 and end surface 16 of the tubular inner member 2 by tightening the threaded exit nozzle against the front end surface 15 of ring 14, thereby completing the formation of the annular water distribution jacket 8. A plurality of tubular members 17 are disposed so as to extend at a sight downstream directed angle of approximately 15 degree at different length (as may be seen in FIGS. 2 and 3) from the water distribution jacket 8 through the inner surface 18 of ring 14 radially inward so as to form a multitude of fluid passages 19 which allows water to flow from the annular water distribution jacked 8 into end 20 of the elongated air transfer chamber 21. Whereby the total space between the tubular members 17 having a typical outside diameter of 5/16 of an inch, causes a flow restriction whose cross-sectional area is optimum.

In operation, a steady stream of compressed air at a pressure of between 85 to 100 psia is introduced through the air inlet port 3 so as to follow a path axially through chamber 21 in which the compressed air undergoes a partial, expansion. Simultaneously, a steady stream of water at substantially the same pressure enters the water inlet port 9 to flow via the annular water distribution jacked 8 and the tubular members 17 semi-radially inward directed into the air transfer chamber 21. As the streams of inwardly directed water exit from ends 22 of tubular members 17, the axially thereto directed stream of compressed air at high velocity tents to collide with the radially inward directed streams of water. In colliding with the radially inward directed streams of water, the air at a substantially greater velocity cause the solid streams of water to be sheared of and to be separate (atomize) into uniformly sized, tiny droplets which undergo a change in direction with the stream of air flow. The so formed water droplets are thoroughly mixed with the expanding air by the violent free turbulent low pressure wake existing in the flow stream just downstream of the tubular members 17. The water droplets are then further accelerated to form a high velocity jet, as the still partially compressed air flows through the constrictive portion 23, and fully expands to atmospheric pressure within the diverging portion 24 of the exit nozzle 13. The partial, nearly adiabatic expansion of the compressed air within the chamber 21 is characterized by a cooling effect generated in the exapansion of compressed air to a somewhat lower pressure, thereby causing, more or less, a pre-cooling of the atomized water droplets. As the still partially compressed air fully expands to atmospheric pressure, the mixture of water droplets and expanding air is further accelerated while the expanding air experiences a further cooling to a degree substantially lower than atmospheric temperature, thus further helping to reduce the temperature of the outwardly projected water droplets. The swiftly moving atmospheric air at low humidity, and at substantially lower than freezing temperature, comes in contact with the water droplet, and thereby, partially by the process of conduction, and partially by the process of evaporative tents to cool the water droplets to the nucleating temperature along the first portion of their trajectory. Along the second portion of their trajectory the water droplets tends to freeze into tiny, crystalline particles of ice before falling to the ground, thereby forming the so, called artificial snow used in the sport of skiing.

What is claimed is:

1. A device for making artificial snow comprising:

a. a housing means having a substantially elongated, first cylindrical member being provided with a longitudinally axially disposed air inlet port at an upstream end, and being provided with a radially disposed, planar surface at a downstream end and an inwardly recessed outer surface intermediate the upstream and downstream ends;

said housing means further having an outer substantially elongated, second cylindrical member being at one end connected to said upstream end of said first cylindrical member so as to form an annular space between said first and said second cylindrical members;

said second cylindrical member further being provided with an internally disposed threaded portion protruding axially, substantially beyond said planar surface of said first cylindrical member;

said second cylindrical member further being provided with a laterally extending water inlet port communicating with said annular space;

b. an annular member for the radial inward distribution of water being of ring like construction having first and second radial disposed planar surfaces, and being provided with a series of slightly downstream angled radially inwardly protruding tubular members of different specific length, said tubular members being in fluid communication with said annular space;

said ringlike member being axially disposed within said second cylindrical member so as to abut with its first radial planar surface against said radial planar surface of said first cylindrical member;

c. a nozzle having at its upstream end an externally threaded portion, a radial disposed surface, and having a converging portion followed by a well rounded constriction, and a diverging portion;

said externally threaded portion being in threaded engagement with said internally threaded portion of said second tubular member so that said radial end surface of said nozzle is in an abutted engagement with said second radial disposed surface of said ringlike member, thereby forming means for the transfer of water from said water inlet port through said series of tubular members into the cavity formed by said first cylindrical member, said ringlike member, and said constrictive member.

* * * * *